US007660544B2

(12) United States Patent
Fujita et al.

(10) Patent No.: US 7,660,544 B2
(45) Date of Patent: Feb. 9, 2010

(54) IMAGE FORMING APPARATUS

(75) Inventors: Masahiko Fujita, Nara (JP); Tadasu Taniguchi, Nara (JP); Norichika Katsura, Nara (JP); Yasunobu Ohkawa, Nara (JP); Yasuhiro Takai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 210 days.

(21) Appl. No.: 11/774,654

(22) Filed: Jul. 9, 2007

(65) Prior Publication Data

US 2008/0013971 A1 Jan. 17, 2008

(30) Foreign Application Priority Data

Jul. 11, 2006 (JP) ..... 2006-190769

(51) Int. Cl.
*G03G 15/00* (2006.01)
*G03G 15/04* (2006.01)

(52) U.S. Cl. ..... 399/85; 399/82; 399/187; 399/188; 399/364

(58) Field of Classification Search ..... 399/82, 399/85, 187, 188, 364
See application file for complete search history.

(56) References Cited

U.S. PATENT DOCUMENTS

2004/0190927 A1* 9/2004 Tsukamoto et al. ..... 399/82

FOREIGN PATENT DOCUMENTS

| | | |
|---|---|---|
| JP | 04-055865 | 2/1992 |
| JP | 10-086350 | 4/1998 |
| JP | 2001-125439 | 5/2001 |

* cited by examiner

*Primary Examiner*—David M Gray
*Assistant Examiner*—Rodney Bonnette
(74) *Attorney, Agent, or Firm*—Renner, Otto, Boisselle & Sklar, LLP

(57) ABSTRACT

In one embodiment of the invention, in an image forming apparatus that reverses the front and back of recording paper by performing switchback transport of the recording paper to perform duplex printing of the recording paper, the image forming apparatus is provided with a control means that, when performing duplex printing of the recording paper, forms a void area at a leading end and a trailing end of the recording paper, the void area preventing curling of the recording paper around a roller.

9 Claims, 5 Drawing Sheets

IMAGE FORMING APPARATUS

This application claims priority under 35 U.S.C. § 119(a) on Japanese Patent Application No. 2006-190769 filed in Japan on Jul. 11, 2006, the entire contents of which are hereby incorporated by reference.

BACKGROUND OF THE INVENTION

1. Field of the Invention

The present invention relates to an image forming apparatus that reverses the front and back of recording paper by performing switchback transport of the recording paper to perform duplex printing of the recording paper.

2. Description of the Related Art

Ordinarily, in an image forming apparatus such as a copy machine, a printer, or a facsimile device, an electrostatic latent image is formed on a photosensitive body, toner is supplied to the photosensitive body from a development apparatus, the electrostatic latent image is made visible on the photosensitive body by the toner, a toner image is formed on the photosensitive body, the toner image is transferred from the photosensitive body to recording paper, heat and pressure are applied to the recording paper, and thus the toner image is fixed on the recording paper.

In a fixing apparatus, heat and pressure are applied to recording paper sandwiched between a hot roller and a pressure roller (also referred to as a fixing roller), so that the toner image is hot-melted on the recording paper and thus fixed.

Incidentally, when a toner image is transferred to an entire sheet of recording paper, and the recording paper is passed between the rollers of the fixing apparatus, it is difficult for the ends of the recording paper to peel away from the rollers due to the adherence of toner to the ends of the recording paper, so the recording paper curls around the rollers and jams may occur.

Therefore, often a void area where a toner image is not transferred is formed at the ends of the recording paper. In the void area at the ends of the recording paper, a toner image is not transferred and so toner adherence does not occur. Thus, even after heat and pressure have been applied to the recording paper between the rollers of the fixing apparatus, the ends of the recording paper can easily be peeled away from the rollers, so the recording paper does not curl around the rollers and jams do not occur.

On the other hand, even when a toner image is transferred to the trailing end of the recording paper, the trailing end of the recording paper is quickly separated from the rollers after the trailing end of the recording paper has passed between the rollers, so a void area is not formed at the trailing end of the recording paper. Conversely, attempts have been made to reduce the margin area of the trailing end of the recording paper as much as possible (see JP H10-86350A).

With respect to printing of recording paper, a margin portion may be provided at the leading end, trailing end, and both sides of the recording paper. These margin portions are set as one item of the print layout of the recording paper, and differ from the void area of the leading end of the recording paper for preventing curling around the rollers. For example, even if the margin portion of the leading end of the recording paper for the print layout has been set to none, a void area of the leading end of the recording paper separate from the margin portion will remain.

Recently, there have been increasing demands for a recording paper duplex printing function in image forming apparatuses. In this duplex printing function, for example, after transfer and fixing of a toner image to the front face of the recording paper ends, transport of the recording paper is temporarily stopped, the recording paper is transported in the opposite direction to the previous stage of the photosensitive body via a detour path, the front and back of the recording paper are reversed, and transfer and fixing of a toner image to the back face of the recording paper are performed.

This sort of transport in order to reverse the front and back of the recording paper is referred to as switchback transport, and when reversing the front and back of the recording paper with this switchback transport, the leading end and the trailing end of the recording paper are switched, so the back face of the recording paper is printed from the trailing end of the recording paper.

However, as previously stated, when printing to the front face of the recording paper, a void area is not formed at the trailing end of the recording paper, so a toner image is printed up to the trailing end of the recording paper. When afterward printing to the back face of the recording paper, when the recording paper is passed between the rollers of the fixing apparatus beginning with the trailing end of the recording paper, it is difficult for the trailing end of the recording paper to peel away from the rollers due to the adherence of toner to the trailing end of the recording paper, so the recording paper curls around the rollers, and so the problem arises that jams occur.

SUMMARY OF THE INVENTION

The present invention was made in view of the above problems in the conventional technology, and it is an object thereof to provide an image forming apparatus in which recording paper does not curl around a roller even when the front and back of recording paper is reversed by switchback transport to perform duplex printing of the recording paper.

In order to address the above problems, the invention provides an image forming apparatus provided with a printing means that reverses the front and back of recording paper by performing switchback transport of the recording paper to perform duplex printing of the recording paper, the image forming apparatus being provided with a control means that, when performing duplex printing of the recording paper, forms a void area in which a toner image is not transferred at a leading end and a trailing end of the recording paper.

Also, the control means controls the time of printing by the printing means according to the length of the recording paper and a start time of transport of the recording paper to the printing means, and forms a void area at the trailing end of the recording paper.

Further, the image forming apparatus of the invention is provided with a fixing means that performs fixing for the recording paper, and the void area of the leading end and the trailing end of the recording paper is formed in order to prevent curling around a fixing roller of the fixing means.

Also, the control means controls transport of the recording paper such that the printing area of the recording paper that follows the void area at the leading end of the recording paper reaches the printing means at the start time of printing to the recording paper by the printing means.

Further, the control means, using the length of the recording paper, obtains the length of time from the start time of transport of the recording paper to the printing means until the void area of the trailing end of the recording paper will reach the printing means, and using this length of time, forms the void area of the trailing end of the recording paper.

Also, the control means obtains the length of time from the start time of transport of the recording paper to the printing means until the void area of the trailing end of the recording paper will reach the printing means, ends writing to the recording paper by the printing means when this length of time has passed, so as to form the void area of the trailing end of the recording paper.

Further, by ending writing to the recording paper by the printing means when the length of time has passed, the void area of the trailing end of the recording paper is a margin.

Also, the control means obtains settings data of the void area at the leading end and the trailing end of the recording paper for each sheet of the recording paper.

Further, with respect to a plurality of sheets of recording paper of the same size, when the control means obtains settings data for the void area at the leading end and the trailing end of the recording paper for one sheet of the recording paper, the settings data of these void areas is also applied to other recording paper.

Also, the image forming apparatus of the invention is provided with a storage means in which settings data of the void area of the leading end and the trailing end of the recording paper is stored for each of various sizes of recording paper, and the control means searches the storage means, and selectively uses settings data of the void area of the leading end and the trailing end of the recording paper that corresponds to a size of the recording paper.

According to the image forming apparatus of the invention configured in this manner, when performing duplex printing of recording paper, a void area is formed at each of the leading end and the trailing end of the recording paper. In the void areas at the leading end and the trailing end, a toner image is not transferred and so toner adherence does not occur. Thus, even when the recording paper is passed between the rollers beginning with the leading end of the recording paper, the leading end of the recording paper easily peels away from the rollers, so the recording paper does not curl around the rollers, and thus jams do not occur. Further, even when the front and back of the recording paper are reversed by switchback transport, a toner image is transferred to the back face of the recording paper, and then the recording paper is passed between the rollers beginning with the trailing end of the recording paper, the trailing end of the recording paper easily peels away from the rollers, so the recording paper does not curl around the rollers, and thus jams do not occur.

For example, when the printing time is controlled by the printing means according to the length of the recording paper and the start time of transport of recording paper to the printing means, it is possible to form a void area of the trailing end of the recording paper.

Also, the void areas at the leading end and the trailing end of the recording paper are provided in order to prevent curling around the fixing roller of the fixing apparatus.

Further, transport of the recording paper is controlled such that the print area of the recording paper that follows the void area at the leading end of the recording paper reaches the printing means at the start time of printing to the recording paper by the printing means. Thus, it is possible to form a void area at the leading end of the recording paper.

Also, using the length of the recording paper, it is possible to obtain the length of time from the start time of transport of the recording paper to the printing means until the void area of the trailing end of the recording paper reaches the printing means, and form the void area of the trailing end of the recording paper using that length of time. Alternatively, it is possible to obtain the length of time from the start time of transport of the recording paper to the printing means until the void area of the trailing end of the recording paper reaches the printing means, and form the void area of the trailing end of the recording paper by ending writing to the recording paper by the printing means at the point in time when that length of time has passed.

Also, when the size of the recording paper is indeterminate or unclear, it is preferable to obtain settings data of the void area of the leading end and the trailing end of the recording paper for each sheet of recording paper. Alternatively, when a plurality of recording papers have the same size, it is preferable that when obtaining the settings data of the void area of the leading end and the trailing end of one sheet of the recording paper, the settings data of these void areas is also applied to other recording paper, thus achieving an acceleration of processing. Further, an acceleration of processing may also be achieved by providing a storage means in which settings data of the void area of the leading end and the trailing end for each of various sizes of recording paper is stored, searching the storage means, and selectively using settings data of the void area of the leading end and the trailing end of the recording paper that corresponds to a size of the recording paper.

DESCRIPTION OF THE PREFERRED EMBODIMENTS

Hereinafter, embodiments of the present invention will be described in detail with reference to the accompanying drawings.

Figure 1:
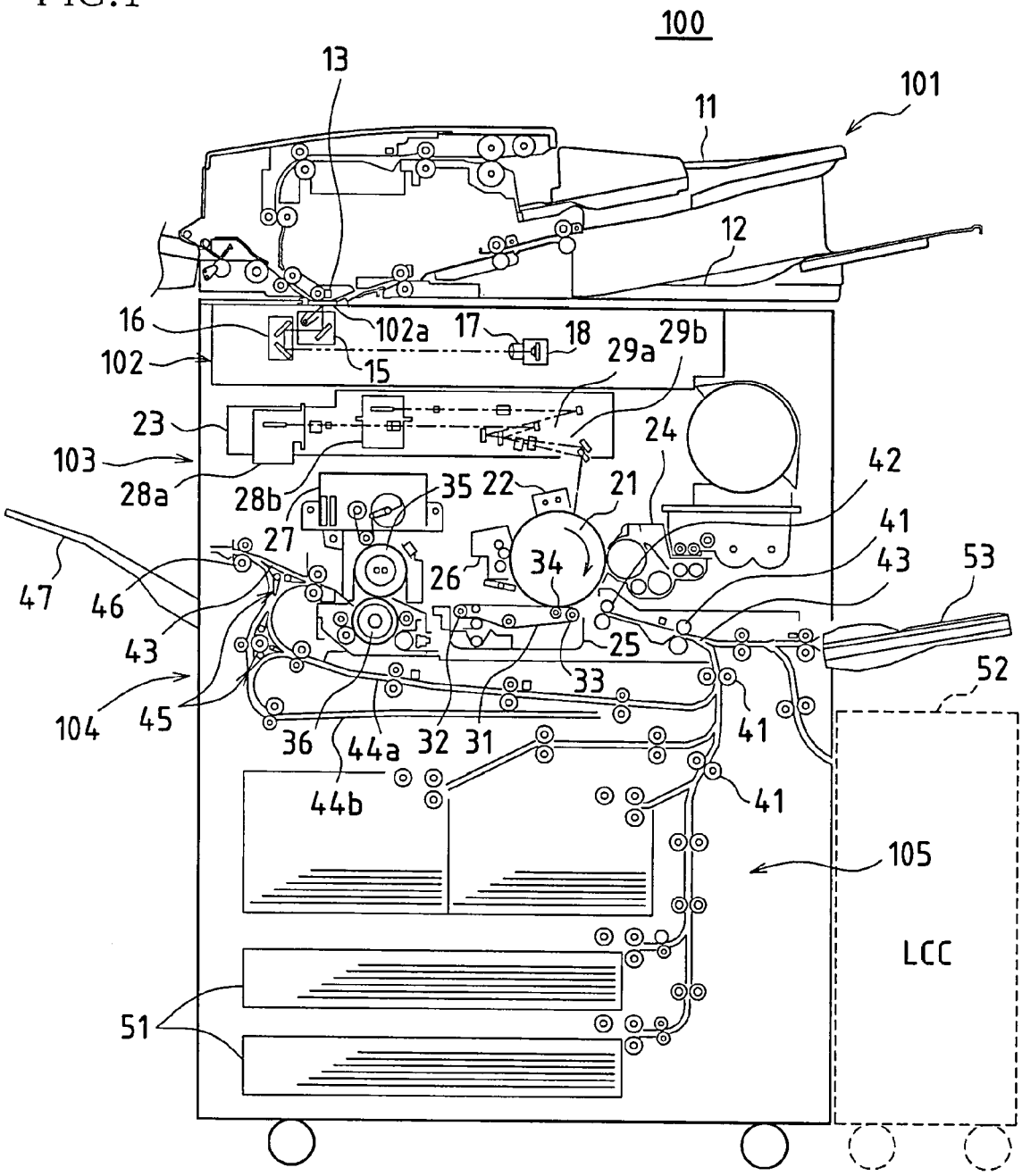
FIG. 1 is a side view that schematically shows the overall configuration of an embodiment of the image forming apparatus according to the invention.

FIG. 1 is a side view that schematically shows the overall configuration of an embodiment of the image forming apparatus according to the invention. An image forming apparatus 100 acquires image data read an original paper, or acquires image data received from outside, and forms a monochrome image indicated by the image data on recording paper. Broadly divided, the image forming apparatus 100 is configured from an automatic document feeder (ADF) 101, an image reading unit 102, a printing unit 103, a recording paper transport unit 104, and a paper feed unit 105.

In the automatic document feeder 101, when at least one sheet of original paper is set in an original setting tray 11, the original paper is drawn out from the original setting tray 11 and transported sheet by sheet, this original paper is guided to and caused to pass by an original reading window 102*a* of the image reading unit 102, and then this original paper is discharged to a discharge tray 12.

A CIS (Contact Image Sensor) 13 is disposed above the original reading window 102*a*. When an original paper passes by the original reading window 102*a*, the CIS 13 repeatedly reads an image of the back face of the original paper in a main scanning direction, and outputs image data expressing the image of the back face of the original paper.

Also, in the image reading unit 102, when an original paper passes by the original reading window 102*a*, the surface of the original paper is exposed by a lamp of a first scanning unit 15, reflected light from the surface of the original paper is guided to an imaging lens 17 by mirrors of the first scanning unit 15 and a second scanning unit 16, and thus an image of the surface of the original paper is formed on a CCD (Charge Coupled Device) 18 by the imaging lens 17. The CCD 18 repeatedly reads an image of the surface of the original paper, and outputs image data that expresses an image of the surface of the original paper.

Further, when the original paper has been placed on a glass platen on the upper face of the image reading unit 102, the first scanning unit 15 and the second scanning unit 16 are moved while maintaining a predetermined speed relationship with each other, the surface of the original paper on the glass platen is exposed by the first scanning unit 15, reflected light from the surface of the original paper is guided to the imaging lens 17 by mirrors of the first scanning unit 15 and the second scanning unit 16, and an image of the surface of the original paper is formed on the CCD 18 by the imaging lens 17.

The image data that has been output from the CIS 13 or the CCD 18 undergoes various image processing by a control circuit of a microcomputer or the like, and then is output to the printing unit 103.

The printing unit 103 records an original expressed by the image data to paper, and is provided with a photosensitive drum 21, a charging unit 22, a laser write unit 23, a development unit 24, a transfer unit 25, a cleaning unit 26, a fixing unit 27, and the like.

After the surface of the photosensitive drum 21 is cleaned by the cleaning unit 26 with the photosensitive drum 21 rotating in one direction, the surface of the photosensitive drum 21 is uniformly charged by the charging unit 22. The charging unit 22 is a charger-type charging unit, but may also be a roller-type or brush-type charging unit that makes contact with the photosensitive drum 21.

The laser write unit 23 is a laser scanning unit (LSU) provided with two laser irradiating units 28*a* and 28*b*, and two mirror groups 29*a* and 29*b*. In the laser write unit 23, image data is input, a laser beam corresponding to this image data is emitted from each of the laser irradiating units 28*a* and 28*b*, these laser beams are irradiated to the photosensitive drum 21 via the mirror groups 29*a* and 29*b*, the uniformly charged surface of the photosensitive drum 21 is exposed, and thus an electrostatic latent image is formed on the surface of the photosensitive drum 21.

In the laser write unit 23, a two-beam method provided with the two laser irradiating units 28*a* and 28*b* is adopted for compatibility with high speed print processing, and thus the burden accompanying acceleration of irradiation timing is lightened.

Instead of a laser scanning unit, it is possible to use an EL write head or LED write head in which light emitting elements are aligned in an array as the laser write unit 23.

In the development unit 24, toner is supplied to the surface of the photosensitive drum 21, and an electrostatic latent image is developed, forming a toner image on the surface of the photosensitive drum 21. The transfer unit 25 transfers the toner image on the surface of the photosensitive drum 21 to recording paper that has been transported by the paper transport unit 104. The fixing unit 27 applies heat and pressure to the recording paper to fix the toner image on the recording paper. Afterward, the recording paper is again transported by the paper transport unit 104 and discharged to a discharge tray 47. Also, the cleaning unit 26 removes and recovers toner remaining on the surface of the photosensitive drum 21 after development and transfer.

Here, the transfer unit 25 is provided with a transfer belt 31, a drive roller 32, a driven roller 33, an elastic electrically conductive roller 34, and the like, and the transfer belt 31 is rotated in a state stretched across the rollers 32 to 34 and other rollers. The transfer belt 31 has a predetermined resistance value (for example, $1\times10^9$ to $1\times10^3$ Ω/cm), and transports recording paper that has been placed on the surface of the transfer belt 31. The elastic electrically conductive roller 34 is pressed against the surface of the photosensitive drum 21 via the transfer belt 31, and thus presses the recording paper on the transfer belt 31 against the surface of the photosensitive drum 21. An electrical field with an opposite polarity to the electrical charge of the toner image on the surface of the photosensitive drum 21 is applied to the elastic electrically conductive roller 34, and the toner image on the surface of the photosensitive drum 21 is transferred to the recording paper on the transfer belt 31 by the electrical field of opposite polarity. For example, when the toner image has an electrical charge with (−) polarity, an electrical field with (+) polarity is applied to the elastic electrically conductive roller 34.

The fixing unit 27 is provided with a hot roller 35 and a pressure roller 36. A heat source for setting the surface of the hot roller 35 to a predetermined temperature (fixing temperature: generally 160 to 200° C.) is provided inside the hot roller 35. Also, an unshown pressure member is disposed at both ends of the pressure roller 36 such that the pressure roller 36 is pressed against the hot roller 35 with a predetermined pressure. When recording paper is transported to a pressure area (referred to as a nip area) between the hot roller 35 and the pressure roller 36, while recording paper is transported by the rollers 35 and 36, the unfixed toner image on the recording paper is hot melted, and pressure is applied, thus fixing the toner image on the recording paper.

The paper transport unit 104 is provided with a plurality of pairs of transport rollers 41 for transporting recording paper, a pair of registration rollers 42, a transport path 43, reverse transport paths 44*a* and 44*b*, a plurality of branch catches 45, and a pair of discharge rollers 46.

In the transport path 43, recording paper is received from the paper feed unit 105 and transported until the leading end of the recording paper reaches the registration rollers 42. Because at this time the registration rollers 42 have been temporarily stopped, the leading end of the recording paper reaches and makes contact with the registration rollers 42, and so the paper bows. Due to the elastic force of the bowed recording paper, the leading end of the recording paper is aligned parallel to the registration rollers 42. Afterward, rotation of the registration rollers 42 is started, the recording paper is transported to the transfer unit 25 of the printing unit 103 by the registration rollers 42, and the recording paper is further transported to the discharge tray 47 by the discharge rollers 46.

Stoppage and rotation of the registration rollers 42 is performed by on/off switching of a clutch between the registration rollers 42 and a drive shaft, and on/off switching of a motor serving as a drive source of the registration rollers 42.

Also, when recording an image also to the back face of recording paper, the branch catches 45 are selectively switched, the recording paper is guided from the transport path 43 into the reverse transport path 44*b*, transport of the recording paper is temporarily stopped, again the branch catches 45 are selectively switched, and the recording paper is guided from the reverse transport path 44*b* into the reverse transport path 44*a*, thus reversing the front and back of the recording paper, and then the recording paper is returned to the registration rollers 42 of the transport path 43 via the reverse transport path 44*a*.

This sort of transport of recording paper is referred to as switchback transport, and with switchback transport, it is possible to reverse the front and back of the recording paper, and at the same time switch the leading end and the trailing end of the recording paper. Accordingly, the trailing end of the recording paper makes contact with the registration rollers 42, the trailing end of the recording paper is aligned parallel to the registration rollers 42, the recording paper is transported to the transfer unit 25 of the printing unit 103 by the registration rollers 42 beginning with the trailing end of the recording paper, printing is performed on the back face of the recording paper, the unfixed toner image on the back face of the recording paper is hot melted and pressure is applied by the nip area between the rollers 35 and 36 of the fixing unit 27, thus fixing the toner image on the back face of the recording paper, and afterward the recording paper is transported to the discharge tray 47 by the discharge rollers 46.

In the transport path 43 and the reverse transport paths 44*a* and 44*b*, sensors that detect the position of the recording paper or the like are disposed at various locations, and based on the position of the recording paper detected by the sensors, driving of the transport rollers and the registration rollers is controlled, and transport and positioning of the recording paper are performed.

The paper feed unit 105 is provided with a plurality of paper feed trays 51. Recording paper is accumulated in the paper feed trays 51, and they are provided toward the bottom of the image forming apparatus 100. Also, the paper feed trays 51 are provided with a pickup roller or the like for drawing out recording paper sheet by sheet, and feed the drawn out recording paper to the transport path 43 of the paper transport unit 104.

Because an object of the image forming apparatus 100 of this embodiment is high speed print processing, a capacity capable of storing 500 to 1500 sheets of recording paper of a determinate size is insured for each paper feed tray 51.

Also, provided in a side face of the image forming apparatus 100 is a large capacity cassette (LCC) 52 capable of storing a large quantity of a plurality of types of recording paper, and a manual feed tray 53 for supplying mainly recording paper of an indeterminate size.

The discharge tray 47 is disposed in the side face of the side opposite to the manual feed tray 53. In this configuration it is also possible to dispose a recording paper post-processing apparatus (that performs stapling, punch processing, or the like) or a plurality of levels of discharge trays as options instead of the discharge tray 47.

Figure 2A:
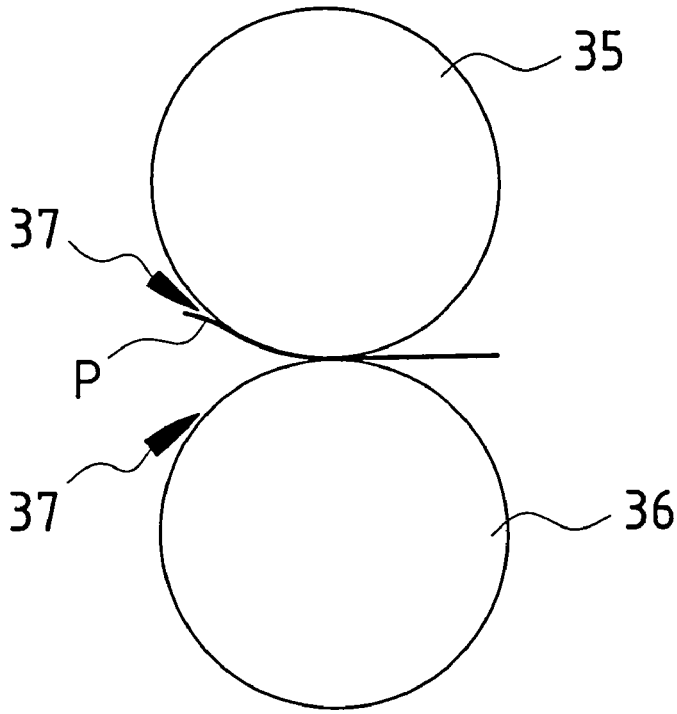
FIG. 2A is a side view that schematically shows an enlarged view of the vicinity of rollers of a fixing unit in the image forming apparatus in FIG. 1, showing the operation of a separation catch of the circumferential face of the rollers.

Incidentally, as shown enlarged in FIG. 2A, respective separation catches 37 are disposed along the circumferential face of each roller 35 and 36 of the fixing unit 27. These separation catches 37 separate the end portion of recording paper P that has passed through the nip area between the rollers 35 and 36 from the rollers, and thus prevent the recording paper from curling around the rollers.

Figure 2B:
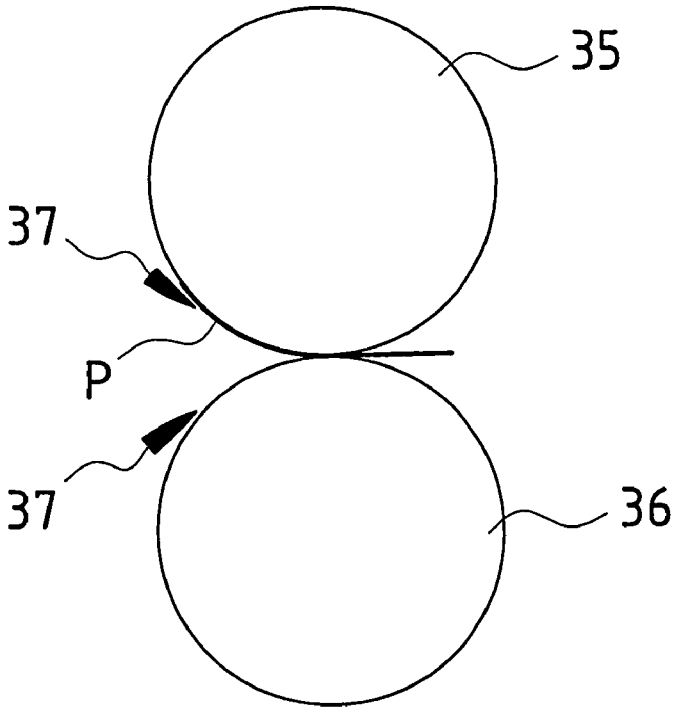
FIG. 2B is a side view that schematically shows an enlarged view of the vicinity of the rollers of a fixing unit in the image forming apparatus in FIG. 1, showing the operation of the separation catch of the circumferential face of the rollers.

However, supposing that a toner image is transferred to the entire surface of the recording paper, and then the recording paper passes through the nip area between the rollers 35 and 36 of the fixing unit 27, the leading end of the recording paper may closely attach to the roller 35 due to the adherence of toner, and in this case, as shown in FIG. 2B, the leading end of the recording paper P passes through the gap between the separation catch 37 and the roller 35, and is sandwiched in this gap, and the recording paper curls around the roller 35, so a jam occurs. Also, as stated above, after the front and back of the recording paper have been reversed by switchback transport, the leading end and the trailing end of the recording paper are switched, so the recording paper passes through the nip area between the rollers 35 and 36 of the fixing unit 27 beginning with the trailing end of the recording paper, and at this time, the trailing end of the recording paper closely attaches to the rollers 36 due to the adherence of the toner, the recording paper curls around the roller 35, and thus a jam occurs.

Therefore, in the image forming apparatus 100 of this embodiment, when performing duplex printing of the recording paper, a void area in the form of a margin is formed at the leading end and the trailing end of the recording paper. Thus, when the recording paper is passed through the nip area between the rollers 35 and 36 beginning with the leading end of the recording paper, and when the recording paper is passed through the nip area beginning with the trailing end of the recording paper, as shown in FIG. 2A, the end portion of the recording paper P rises up from the circumferential face of the roller, so the end portion of the recording paper is easily peeled away by the separation catch 37, and the recording paper does not curl around the roller, and thus a jam does not occur.

Figure 3:
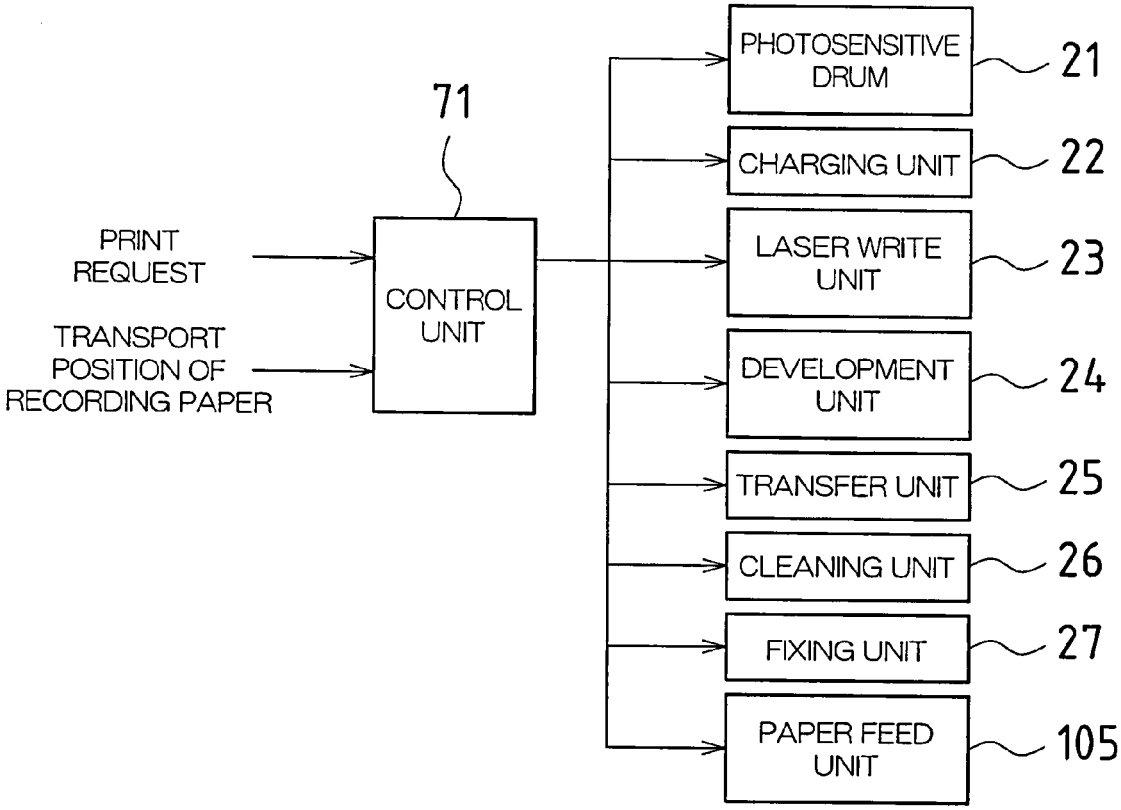
FIG. 3 is a block diagram that shows a control system in the image forming apparatus in FIG. 1.

FIG. 3 is a block diagram that shows a control system that performs control for forming respective void areas at the leading end and the trailing end of recording paper.

In FIG. 3, the control unit 71 performs overall control of the image forming apparatus 100. The control unit 71 inputs a print request, and inputs the transport position of the recording paper in the transport path 43 and the reverse transport paths 44*a* and 44*b*, and based on the print request and the transport position of the recording paper and the like, the control unit 71 controls driving of the photosensitive drum 21, the charging unit 22, the laser write unit 23, the development unit 24, the transfer unit 25, the cleaning unit 26, the fixing unit 27, the paper feed unit 105, and the like, and while performing printing of the front face or the back face of the recording paper, the control unit 71 forms respective void areas at the leading end and the trailing end of the recording paper.

Figure 4:
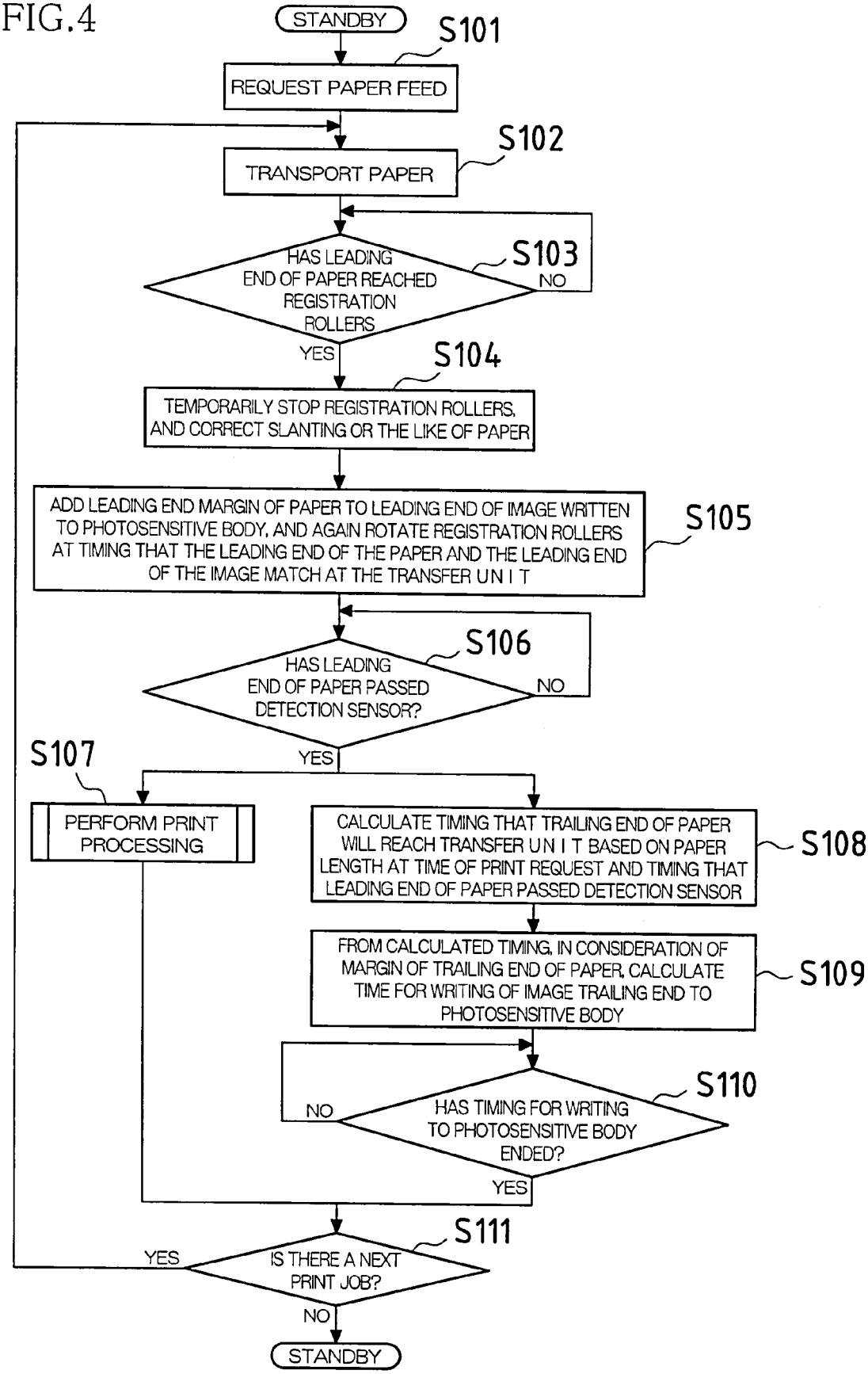
FIG. 4 is a flowchart that shows a control procedure for forming a void area of recording paper in the image forming apparatus in FIG. 1.

Next is a description of the control procedure for forming the respective void areas at the leading end and the trailing end of the recording paper, with reference to the flowchart in FIG. 4.

First, when there is a print request (Step S101), the control unit 71 selects one of the paper supply trays 51 of the paper feed unit 105, performs driving control of the pickup roller or the like of the paper feed tray 51 to supply recording paper from the paper feed tray 51 to the transport path 43 (Step S102), and in a state with the registration rollers 42 of the transport path 43 temporarily stopped, waits for the leading end of the recording paper to be detected by a sensor immediately before the registration rollers 42, i.e., waits for the leading end of the recording paper to reach the registration rollers 42 (Step S103). When the leading end of the recording paper has reached the registration rollers 42 ("Yes" in Step S103), the control unit 71 causes the leading end of the recording paper to make contact with the registration rollers 42, and aligns the leading end of the recording paper parallel with the registration rollers 42 (Step S104).

At this time, the control unit 71 controls the laser write unit 23 so that writing of an electrostatic latent image to the photosensitive drum 21 is started. Following this writing, the electrostatic latent image on the photosensitive drum 21 is developed by the development unit 24 to form a toner image on the photosensitive drum 21. Then, the control unit 71 starts rotational driving of the registration rollers 42 such that a start position of the print area of the recording paper reaches the transfer position at the timing that the leading end of the toner image on the photosensitive drum 21 reaches a position for transfer by the transfer unit 25, thus starting transport of the recording paper (Step S105).

However, the start position of the print area of the recording paper face is separated from the leading end of the recording paper by the width of the void area of the leading end.

Here, the position for writing of the electrostatic latent image, the rotational speed of the photosensitive drum 21, and the position for transfer by the transfer unit 25 have been set, and there is a fixed length of time from the point in time when writing of the electrostatic latent image starts to the point in time when transfer of the toner image starts, so provided that the point in time when writing of the electrostatic latent image starts has been set, the point in time when transfer of the toner image starts is known. Also, the distance from the position of the registration rollers 42 to the position for transfer by the transfer unit 25, the width of the void area of the leading end of the recording paper, and the transport speed of the recording paper have been set, so the distance from the start position of the print area of the recording paper in contact with the registration rollers 42 to the transfer position is known, and thus a transport time T necessary to transport recording paper this distance is known.

Accordingly, the control unit 71 obtains the time for starting transfer of the toner image from the time for starting writing of the electrostatic latent image to the photosensitive drum 21, and when transport of recording paper by the registration rollers 42 is started at a time obtained by moving backwards the transport time T from the toner image transfer start time, it is possible to cause the leading end of the toner image on the photosensitive drum 21 to arrive at the recording paper print area start position at the timing that the leading end of the toner image on the photosensitive drum 21 arrives at the position for transfer by the transfer unit 25.

When, in this manner, the control unit 71 starts rotational driving of the registration rollers 42 to start transport of the recording paper, the control unit 71 then waits for the leading end of the recording paper to be detected by a sensor immediately after the registration rollers 42, i.e., waits for the leading end of the recording paper to pass the registration rollers 42 (Step S106). When the leading end of the recording paper passes the registration rollers 42 ("Yes" in Step S106), print processing of the print area of the recording paper is performed, i.e., the electrostatic latent image on the photosensitive drum 21 is developed by the development unit 24, the toner image is transferred to the print area of the recording paper by the transfer unit 25, and the like (Step S107).

Figure 5:
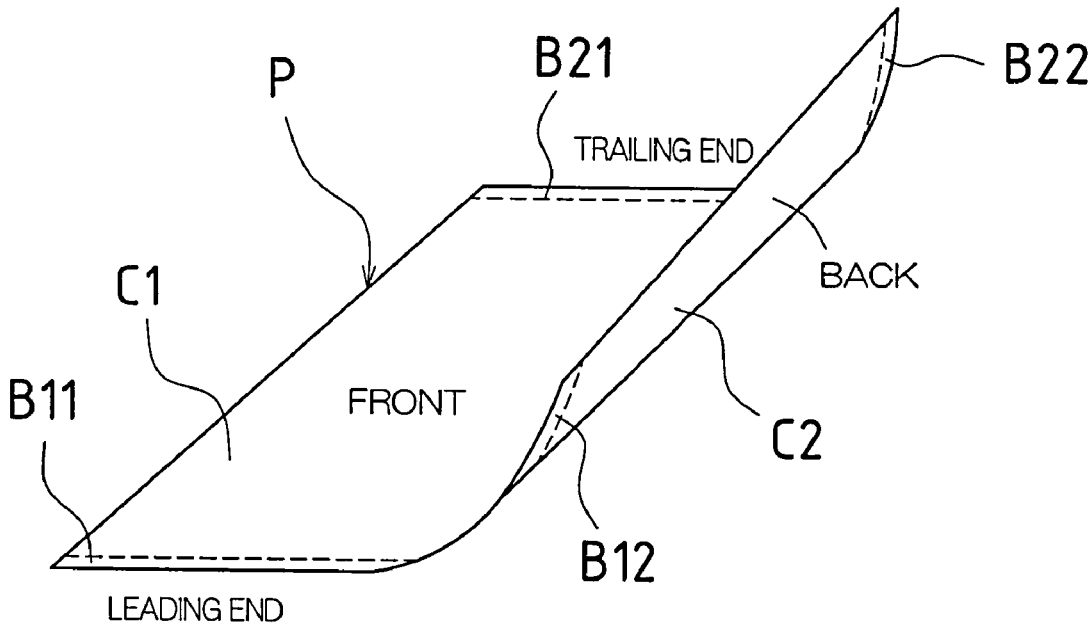
FIG. 5 is a perspective view that shows an example of the void area of recording paper.

Thus, as shown in FIG. 5, a marginal void area B11 is formed at the leading end of the front face of the recording paper P, and a toner image is formed in a print area C1 that is continuous from the void area B11. For example, a marginal area with a width of 2 to 3 mm is formed as the void area B11.

On the other hand, parallel with the recording paper print processing, a void area is set for the trailing end of the recording paper. In order to do so, the control unit 71 obtains the length of the recording paper. For example, when the length of time from detection of the leading end of the recording paper by a sensor upstream from the registration rollers 42 until detection of the trailing end is measured, because the transport speed of the recording paper is fixed, it is possible to obtain the length of the recording paper based on the measured length of time and the transport speed. Also, when the sizes of recording paper stored in each paper feed tray 51 of the paper feed unit 105 are respectively fixed, it is possible to select a paper feed tray 51, identify the size of recording paper when receiving supply of the recording paper from that paper feed tray 51, and thus obtain the length of that recording paper. The control unit 71 obtains the length from the leading end of the recording paper to the start position of the void area of the trailing end of the recording paper, based on the length of the recording paper and the width of the void area that has been set in advance. Further, the control unit 71 obtains the timing that the start position of the void area of the trailing end of the recording paper reaches the position for transfer by the transfer unit 25 based on the length from the leading end of the recording paper to the void area of the trailing end, when the leading end of the recording paper was detected by the sensor immediately after the registration rollers 42, the distance from the position of that sensor to the position for transfer by the transfer unit 25, and the transport speed of the recording paper (Step S108).

Specifically, the control unit 71 obtains a sum of the length from the leading end of the recording paper to the void area of the trailing end and the distance from the position of the sensor immediately after the registration rollers 42 to the transfer position, divides this sum by the transport speed of the recording paper, and thus obtains the length of time from when the leading end of the recording paper was detected by the sensor immediately after the registration rollers 42 until the start position of the void area of the trailing end of the recording paper reaches the transfer position.

Further, the control unit 71 obtains a write time of the electrostatic latent image to the photosensitive drum 21, such that the trailing end of the toner image on the photosensitive drum 21 reaches the transfer position at the timing that the start position of the void area of the trailing end of the recording paper reaches the position for transfer by the transfer unit 25 obtained in Step S108 (Step S109).

Specifically, because the length of time from the start time for writing of the electrostatic latent image until the start time for transfer of the toner image is fixed, the control unit 71 obtains a timing that the writing of the electrostatic latent image to the photosensitive drum 21 ends, at that fixed length of time prior to the timing that the start position of the void area of the trailing end of the recording paper reaches the position for transfer by the transfer unit 25 obtained in Step S108.

Until the timing that writing ends obtained in Step S109, the control unit 71 continues writing the electrostatic latent image to the photosensitive drum 21 (Step S110), and when this timing arrives, writing of the electrostatic latent image to the photosensitive drum 21 is ended ("Yes" in Step S110).

Thus, as shown in FIG. 5, a marginal void area B21 is formed at the trailing end of the front face of the recording paper P. For example, a marginal area with a width of 2 to 3 mm is formed as the void area B21.

When formation of the toner image of the print area of the front face of the recording paper and formation of the void area B11 of the leading end and the void area B21 of the trailing end in this manner are finished, this recording paper is passed through the nip area between the rollers 35 and 36 of the fixing unit 27, fixing the toner image of the print area of the front face of the recording paper. When performing fixing for the front face of the recording paper, the void area B11 is formed at the leading end of the front face of the recording paper, so as shown in FIG. 2A, the void area B11 of the leading end of the front face of the recording paper rises up from the circumferential face of the roller 35, so the end portion of the recording paper can be easily peeled away by the separation catch 37, and thus the recording paper does not curl around the rollers.

Next, the control unit 71 performs a check of whether or not there is a next print request (Step S111), and when there is not a print request ("No" in Step S111), the processing in FIG. 4 ends.

When there is a print request ("Yes" in Step S111), the processing returns to Step S102. When the print request in Step S111 is for a second sheet of recording paper P, as in the case of the first sheet of recording paper, two sheets of recording paper are supplied from the paper feed tray 51 to the transport path 43 (Step S102), the processing following Step S103 is performed, and thus a toner image is formed in the print area of the front face of the recording paper.

Also, when the print request in Step S111 is for the back face of one sheet of recording paper P, as stated previously, the front and back of the recording paper are reversed by switch-back transport, switching the leading end and the trailing end of the recording paper, and then the recording paper is returned to the registration rollers 42 of the transport path 43 via the reverse transport path 44*a* (Step S102).

At this time, the leading end and the trailing end of the recording paper are switched, so the recording paper is guided to the transport path 43 beginning with the trailing end of the recording paper.

The control unit 71, in a state in which the registration rollers 42 of the transport path 43 have been temporarily stopped, waits for the trailing end of the recording paper to reach the registration rollers 42 (Step S103), and when the trailing end of the recording paper has reached the registration rollers 42 ("Yes" in Step S103), the control unit 71 causes the trailing end of the recording paper to make contact with the registration rollers 42, and aligns the trailing end of the recording paper parallel with the registration rollers 42 (Step S104).

At this time, writing of the electrostatic latent image to the photosensitive drum 21 has started, and following this writing, the electrostatic latent image on the photosensitive drum 21 is developed by the development unit 24, forming a toner image on the photosensitive drum 21.

Then, the control unit 71 starts rotational driving of the registration rollers 42 such that the start position of the print area of the back face of the recording paper reaches the transfer position at the timing that the leading end of the toner image on the photosensitive drum 21 reaches the position for transfer by the transfer unit 25, thus starting transport of the recording paper. However, the start position of the print area of the back face of the recording paper is separated from the trailing end of the recording paper by the width of the void area of the trailing end of the recording paper. Printing of the front face of the recording paper is already finished, and the recording paper has already once passed through the nip area between the rollers 35 and 36 of the fixing unit 27, so the length of the recording paper is slightly extended at a fixed ratio, and the length of the print area of the front face of the recording paper, and the length of the void of the leading end and the trailing end of the front face of the recording paper, are also extended at a fixed ratio. So, the control unit 71 obtains the width of the slightly extended voids by multiplying the original width of the void areas by the fixed ratio, and the control unit 71 starts rotational driving of the registration rollers 42 such that the print area start position that follows the slightly extended void area of the back face of the recording paper reaches the transfer position at the timing that the leading end of the toner image on the photosensitive drum 21 reaches the transfer position, thus starting transport of the recording paper (Step S105).

Further, when the control unit 71 starts transport of the recording paper, the control unit 71 then waits for the trailing end of the recording paper to pass the registration rollers 42 (Step S106). When the trailing end of the recording paper passes the registration rollers 42 ("Yes" in Step S106), print processing of the print area of the back face of the recording paper is performed (Step S107).

Thus, as shown in FIG. 5, a marginal void area B22 is formed at the trailing end of the back face of the recording paper P, and a toner image is formed in a print area C2 that is continuous from the void area B22.

Also, parallel with the print processing for the back face of the recording paper, a void area is set for the leading end of the back face of the recording paper. In order to do so, the control unit 71 first obtains the length of the recording paper. As stated previously, the recording paper has already once passed through the nip area between the rollers 35 and 36 of the fixing unit 27, so the length of the recording paper is slightly extended at a fixed ratio. Thus the control unit 71 obtains the length of the slightly extended recording paper by multiplying the length of the recording paper obtained at the time of print processing of the front face of the recording paper by a fixed ratio. Also, the control unit 71 obtains the length from the trailing end of the recording paper to the start position of the void area of the slightly extended leading end based on the length of the lightly extended recording paper and the width of the slightly extended void area that was previously obtained. Based on this length, when the trailing end of the recording paper was detected by the sensor immediately after the registration rollers 42, the distance from the position of that sensor to the transfer position, and the transport speed of the recording paper, the control unit 71 obtains the timing that the start position of the void area of the slightly extended leading end of the recording paper reaches the transfer position (Step S108).

Further, the control unit 71 obtains a write time of the electrostatic latent image to the photosensitive drum 21, such that the trailing end of the toner image on the photosensitive drum 21 reaches the transfer position at the timing that the start position of the void area of the slightly extended leading end of the recording paper reaches the position for transfer by the transfer unit 25 obtained in Step S108 (Step S109).

Until the timing that writing ends obtained in Step S109, the control unit 71 continues writing the electrostatic latent image to the photosensitive drum 21 (Step S110), and when this timing arrives, writing of the electrostatic latent image to the photosensitive drum 21 is ended ("Yes" in Step S110).

Thus, as shown in FIG. 5, a slightly extended void area B12 is formed at the leading end of the back face of the recording paper P.

When printing to the print area of the back face of the recording paper and formation of the void area B22 of the trailing end and the void area B12 of the leading end of the back face of the recording paper in this manner are finished, this recording paper is passed through the nip area between the rollers 35 and 36 of the fixing unit 27, fixing the toner image of the print area of the back face of the recording paper. When performing fixing for the back face of the recording paper, since the void area B22 is formed at the trailing end of the back face of the recording paper, the void area B22 of the trailing end of the back face of the recording paper rises up from the circumferential face of the roller 35 even when the back face of the recording paper closely attaches to the roller 35, so the leading end portion of the recording paper can be easily peeled away by the separation catch 37. Also, even when the front face of the recording paper closely attaches to the roller 36, the void area B21 of the trailing end of the front face of the recording paper rises up from the circumferential face of the roller 36, so the leading end portion of the recording paper can be easily peeled away by the separation catch 37. Accordingly, the recording paper does not curl around the rollers.

Afterward, the control unit 71 performs a check of whether or not there is a next print request (Step S111). When there is not a print request ("No" in Step S111), the processing in FIG. 4 ends, and when there is a print request ("Yes" in Step S111), the processing returns to Step S102.

Afterward, in the same manner as described above, when printing of the front face of the recording paper is performed, the void area B11 of the leading end of the front face of the recording paper, the print area, and the void area B21 of the trailing end are formed in order, the toner image of the print area of the front face of the recording paper is fixed, and when printing is subsequently also performed on the back face of the recording paper, the leading end and the trailing end of the recording paper are switched, so the void area B22 of the trailing end of the back face of the recording paper, the print area, and the void area B12 of the leading end are formed in order, and the toner image of the print area of the back face of the recording paper is fixed.

Accordingly, when performing fixing of the back face of the recording paper, the void areas B21 and B22 are present at the trailing end of both the front face and the back face of the recording paper, so even when the recording paper passes through the nip area between the rollers 35 and 36 of the fixing unit 27 beginning with the trailing end of the recording paper, the void areas B21 and B22 of the front face and the back face of the recording paper rise up from the circumferential face of both of the rollers 35 and 36, so the end portion of the recording paper can be easily peeled away by the separation catch 37.

In this manner, with this embodiment, when performing printing of the front face of the recording paper, not only the void area B11 of the leading end of the front face of the recording paper, but also the void area B21 of the trailing end of the front face is formed, and when performing the following printing of the back face of the recording paper, the void area B22 of the trailing end of the back face of the recording paper is formed. Thus, when performing fixing of the toner image of the front face of the recording paper, the void area B11 of the leading end of the front face of the recording paper rises up from the circumferential face of the roller 35 of the fixing unit 27, so the end portion of the recording paper can be easily peeled away by the separation catch 37, and thus the recording paper does not curl around the roller. Also, when performing fixing of the toner image of the back face of the recording paper, the void areas B21 and B22 of the trailing end of the front face and the back face of the recording paper rise up from the circumferential face of both of the rollers 35 and 36 of the fixing unit 27, so the end portion of the recording paper can be easily peeled away by the separation catch 37.

Accordingly, even when the front and back of the recording paper are reversed by switchback transport, and a toner image is transferred to the back face of the recording paper, and then the recording paper is passed between the rollers 35 and 36 of the fixing unit 27 beginning with the trailing end of the recording paper, the trailing end of the recording paper does not curl around the rollers, and so jams do not occur.

Also, due to fixing of the front face of the recording paper, the length of the recording paper is extended at a fixed ratio, and the void area of the leading end and the trailing end of the front face is also extended at a fixed ratio, so when printing the back face of the recording paper, the width of the void area of the leading end and the trailing end is also formed extended at a fixed ratio. Thus, between the front face and the back face of the recording paper, the void areas of the leading end and the trailing end accurately overlap each other, and the print areas also accurately overlap each other, so printing can be performed without the print area of the front face and the print area of the back face being offset from each other.

Also note that the invention is not limited to the above embodiments, and can be variously modified. For example, when printing only to the front face of the recording paper, and not to the back face, a configuration may be adopted in which the void area B21 of the trailing end of the front face of the recording paper is omitted, and the print area is enlarged by the extent of the omitted void area B21.

Also, when printing to the front face and the back face of the recording paper, the void area B12 of the leading end of the back face of the recording paper may be omitted. This is because when the recording paper is passed between the rollers 35 and 36 of the fixing unit 27 beginning with the trailing end of the recording paper, there is no effect when the leading end of the recording paper closely attaches to the rollers, so it is adequate to be able to prevent the trailing end of the recording paper from closely attaching to the rollers.

Also, in order to set the void area B21 of the trailing end of the front face of the recording paper or the void area B12 of the leading end of the back face, the length of time until the void area of the trailing end of the recording paper will reach the transfer position is obtained using the paper length, the distance from the position of the sensor immediately after the registration rollers 42 to the position for transfer by the transfer unit 25, and the transport speed of the recording paper, but when the size of the paper does not change, this length of time will not change, so when repeating recording to paper of the same size, this length of time may be invoked. For example, when feeding a plurality of sheets of paper from the same paper feed tray 51, recording to paper of the same size is repeated, so when this length of time is once obtained, this length of time can be invoked.

Alternatively, a configuration may be adopted in which the length of time until the void area of the trailing end of the recording paper will reach the transfer position is stored in a memory for each of various sizes of recording paper, and when printing to the recording paper, the memory is searched, and a length of time corresponding to the size of that recording paper is selectively used.

Also, the void area according to the invention differs from a margin portion set as one item of the print layout of the recording paper, and even if the margin portion of the leading end and the trailing end of the recording paper for the print layout has been set to none, a void area of the leading end and the trailing end of the recording paper separate from the margin portion will remain.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. An image forming apparatus comprising:

a printing means that reverses a front face and back face of recording paper by performing switchback transport of the recording paper to perform duplex printing of the recording paper, a control means that, when printing of the front face of the recording paper, forms a void area in which a toner image is not transferred at a leading end and a trailing end of the recording paper, and when successive printing of the back face of the recording paper, forms the void area of slightly extended width, obtained by multiplying the width of the void area of the front face by a fixed ratio, at the trailing end of the back face of the recording paper, the fixed ratio being a ratio at which is extended the width of the void area of the front face of the recording paper after passing through a nip area between rollers of a fixing unit upon printing of the front face of the recording paper.

2. The image forming apparatus according to claim 1, wherein the control means controls the time of printing by the printing means according to the length of the recording paper and a start time of transport of the recording paper to the printing means, and forms a void area at the trailing end of the recording paper.

3. The image forming apparatus according to claim 1, comprising a fixing means that performs fixing for the recording paper, wherein the void area of the leading end and the trailing end of the recording paper is formed in order to prevent curling around a fixing roller of the fixing means.

4. The image forming apparatus according to claim 1, wherein the control means controls transport of the recording paper such that the printing area of the recording paper that follows the void area at the leading end of the recording paper reaches the printing means at the start time of printing to the recording paper by the printing means.

5. The image forming apparatus according to claim 1, wherein the control means, using the length of the recording paper, obtains the length of time from the start time of transport of the recording paper to the printing means until the void area of the trailing end of the recording paper will reach the printing means, and using this length of time, forms the void area of the trailing end of the recording paper.

6. The image forming apparatus according to claim 1, wherein the control means obtains the length of time from the start time of transport of the recording paper to the printing means until the void area of the trailing end of the recording paper will reach the printing means, ends writing to the recording paper by the printing means when this length of time has passed, so as to form the void area of the trailing end of the recording paper.

7. The image forming apparatus according to claim 1, wherein the control means obtains settings data of the void area at the leading end and the trailing end of the recording paper for each sheet of the recording paper.

8. The image forming apparatus according to claim 1, wherein with respect to a plurality of sheets of recording paper of the same size, when the control means obtains settings data for the void area at the leading end and the trailing end of the recording paper for one sheet of the recording paper, the settings data of these void areas is also applied to other recording paper.

9. The image forming apparatus according to claim 1, comprising a storage means in which settings data of the void area of the leading end and the trailing end of the recording paper is stored for each of various sizes of recording paper, wherein the control means searches the storage means, and selectively uses settings data of the void area of the leading end and the trailing end of the recording paper that corresponds to a size of the recording paper.

* * * * *